US007571560B2

(12) United States Patent
Peterman

(10) Patent No.: US 7,571,560 B2
(45) Date of Patent: Aug. 11, 2009

(54) INFORMATION DISPLAY ASSEMBLY

(76) Inventor: Robert J. Peterman, P.O. Box 21327, Eugene, OR (US) 97402

( * ) Notice: Subject to any disclaimer, the term of this patent is extended or adjusted under 35 U.S.C. 154(b) by 0 days.

(21) Appl. No.: 12/082,569

(22) Filed: Apr. 11, 2008

(65) Prior Publication Data

US 2008/0189999 A1 Aug. 14, 2008

Related U.S. Application Data

(63) Continuation-in-part of application No. 11/484,524, filed on Jul. 10, 2006, now abandoned.

(51) Int. Cl.
*G09F 21/04* (2006.01)

(52) U.S. Cl. ..... 40/591; 40/643; 40/658; 24/336; 24/349; 24/563

(58) Field of Classification Search ..... 40/591, 40/592, 643, 644, 654.01, 658; 24/3.1, 3.12, 24/336, 349, 563; 248/490, 214, 215, 563
See application file for complete search history.

(56) References Cited

U.S. PATENT DOCUMENTS

2004/0079015 A1* 4/2004 Tuttle ..... 40/661
2006/0059756 A1* 3/2006 Wells ..... 40/654.01
2006/0231220 A1* 10/2006 Huang ..... 160/370.21

* cited by examiner

*Primary Examiner*—Cassandra Davis
(74) *Attorney, Agent, or Firm*—Timothy E. Siegel Patent Law, PLLC

(57) ABSTRACT

A method of presenting sales information to an automobile customer on an automobile having a window that may be slid vertically within a window frame. The method uses an informational slip and a slip holder sized to accept the information slip. The slip holder includes a clip defines a downwardly facing open channel and a tongue extending downwardly from the front wall. Also, a sheet of resiliently deformable material is attached to the tongue and bent backwards at a bending point defining the sheet holder bottom and a rear panel extending upwardly from the bending point. The informational slip is placed on the car window so that information is displayed through the front portion, which is transparent. The clip is formed so as to press the sheet into the window, thereby acting to reduce gaps between the informational slip and the front panel and, as a consequence, enhancing slip visibility.

12 Claims, 3 Drawing Sheets

INFORMATION DISPLAY ASSEMBLY

CROSS-REFERENCE TO RELATED APPLICATION

This application is a continuation-in-part of application Ser. No. 11/484,524, filed Jul. 10, 2006 now abandoned.

BACKGROUND

In the United States all new cars offered for sale must be labeled with a mandated set of information. Until now this has typically been done by adhering a sticker to the front window of the car. Unfortunately, after the car has been sold, the removal of this sticker presents a time consuming and relatively expensive task that many dealerships would very much like to avoid, if they could. Although some devices have been offered for holding the informational slip in place, they have tended to be somewhat cumbersome and expensive, or flimsy and unprofessional in appearance. Moreover, with existing devices gaps may occur between the transparent pocket that holds the informational slip and the slip itself. Such gaps may cause reflections that make it much more difficult to read the information on the slip.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

Preferred embodiments of the present invention take the form of an apparatus and a method for presenting sales information to an automobile customer on an automobile having a window that may be slid vertically within a window frame having a top channel. The method uses an informational slip and a slip holder sized to accept and retain the informational slip. The slip holder has a clip at its topfront and this clip has a front wall and a rear wall, mutually joined together by a top wall, the walls together defining a downwardly facing open channel, a tongue extending downwardly from the front wall. A sheet of resiliently deformable material has a transparent front panel that is attached to and extends downwardly from the tongue. Also the sheet is bent backwards at a bending point defining the sheet holder bottom and a rear panel extending upwardly from the bending point and defining an interior between the front panel and the rear panel. In the method, the informational slip is placed in the interior so that information is displayed through the front panel and the clip is engaged to the top of the automobile window so that the plastic sheet extends downwardly in front of the car window and engages the window to the top channel of the window frame. Finally, the clip is formed so as to press the sheet into the window, thereby acting to reduce any gaps between the informational slip and the front panel and, as a consequence, enhancing slip visibility.

In addition to the exemplary aspects and embodiments described above, further aspects and embodiments will become apparent by reference to the drawings and by study of the following detailed descriptions.

Exemplary embodiments are illustrated in referenced figures of the drawings. It is intended that the embodiments and figures disclosed herein are to be considered illustrative rather than restrictive.

DETAILED DESCRIPTION OF THE PREFERRED EMBODIMENT

Figure 1:
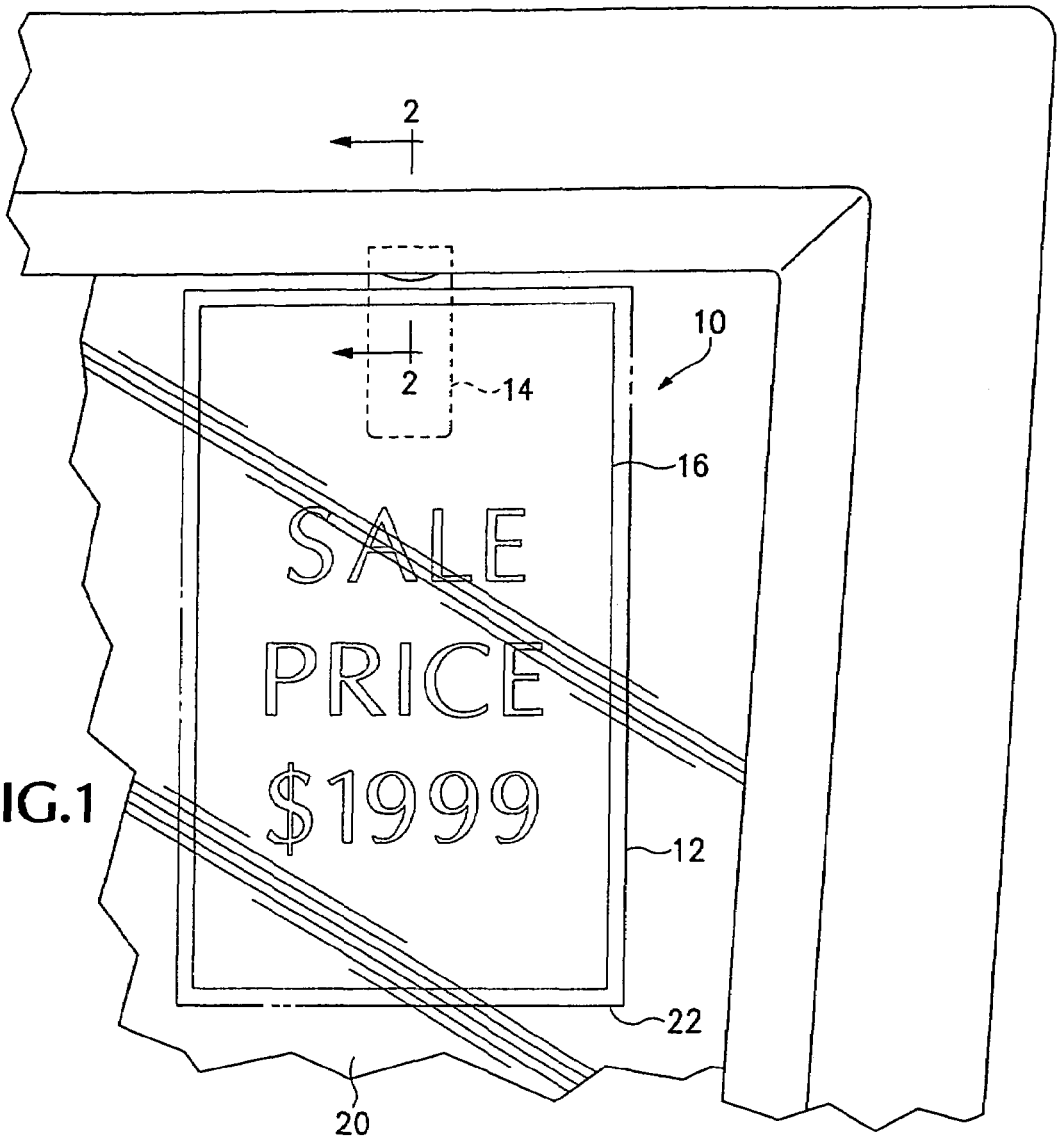
FIG. 1 is a front view of a display assembly according to the present invention shown in place on a car window, hosting an informational sticker.
Figure 2:
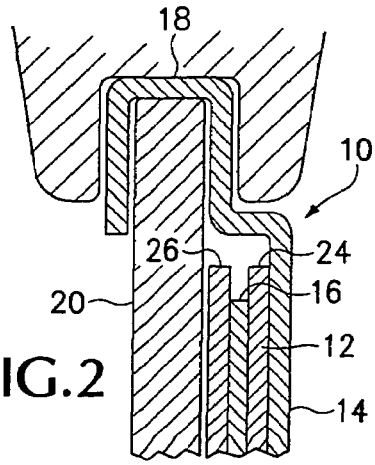
FIG. 2 is a sectional view of the display assembly of FIG. 1, taken along line 2-2 of FIG. 1.

Referring to FIG. 1, in a preferred embodiment a display assembly 10 having a transparent sheet 12 and a clip 14 is used to display an informational slip 16. Clip 14 defines an upside-down channel 18 that fits over the top of a car window 20. Transparent sheet 12 is a single sheet of stiff but resiliently bendable transparent plastic that has a crease 22 at the bottom, to form a first panel 24 and a second panel 26.

Figure 3:
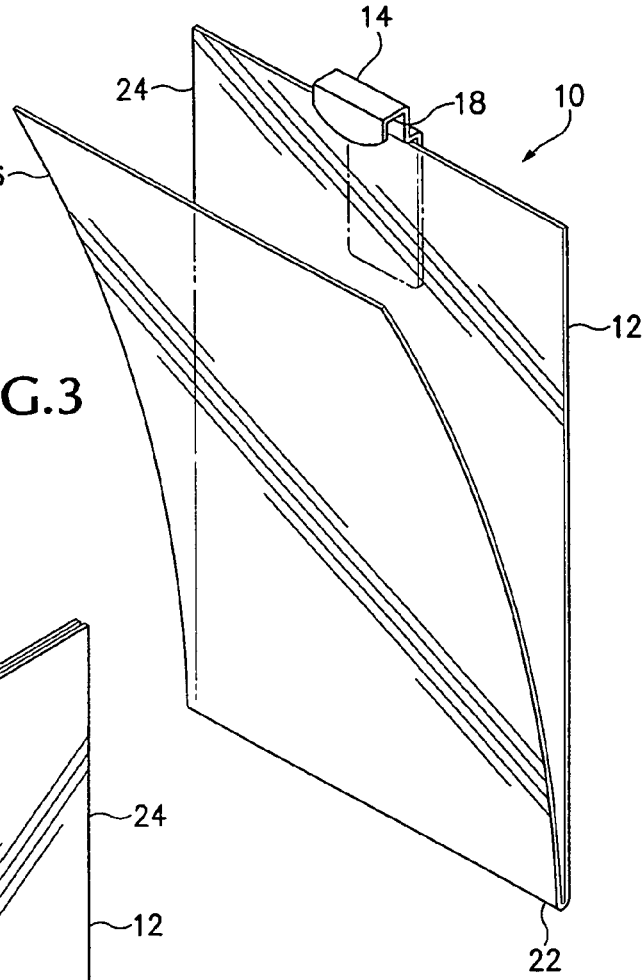
FIG. 3 is a perspective view of the display assembly of FIG. 1, showing it open and ready to receive a paper.
Figure 4:
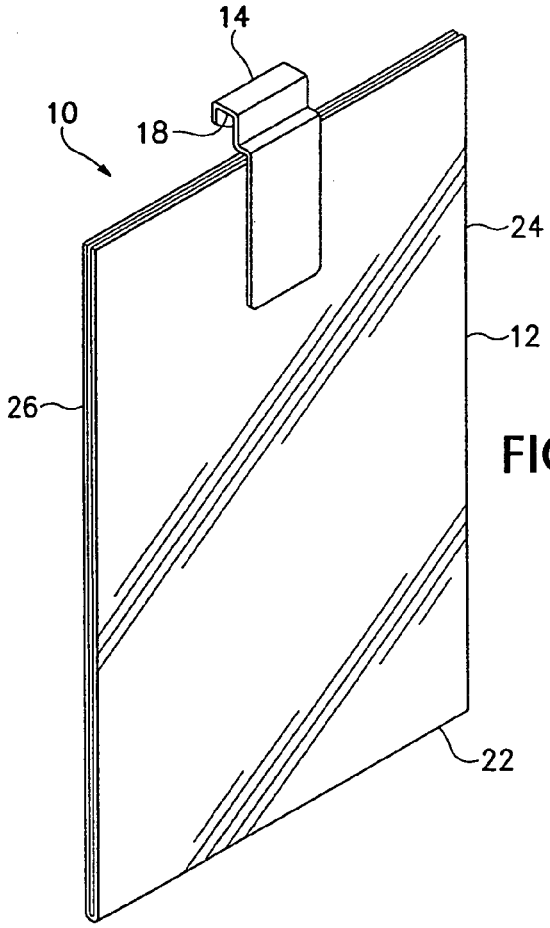
FIG. 4 is a perspective view of the display assembly of FIG. 1, showing it closed.

To use, second panel 26 is bent slightly outwardly, as shown in FIG. 3, and informational slip 16 is placed between first panel 24 and second panel 26, so that it faces second panel 26. Upside-down channel 18 is then placed on top of car window 20, so that second panel 26 is adjacent to the window 20, which panel 26 from bending outwardly. This maintains second panel 26 in abutting contact with informational slip 16, so that slip 16 is pressed between second panel 26 and first panel 24. This pressure, in turn, affirmatively retains slip 16.

Figure 6:
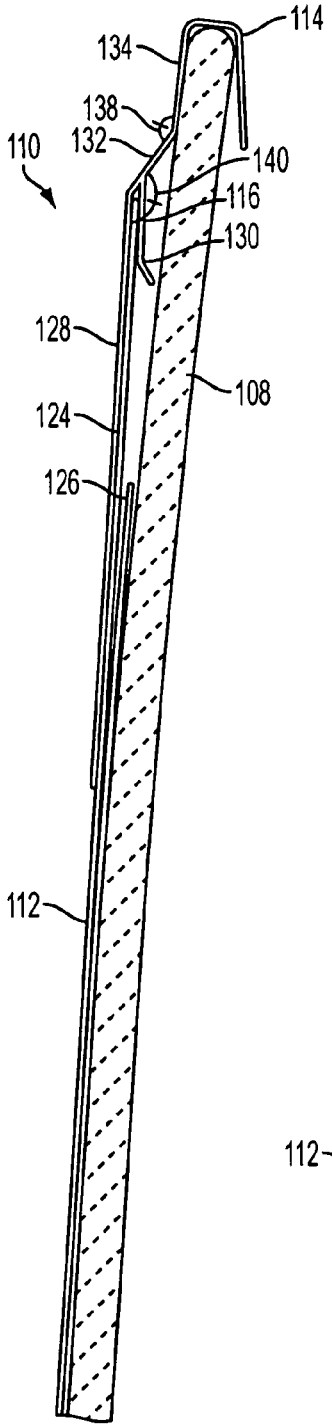
FIG. 6 is a side sectional view of the display assembly of FIG. 5, in use on a car window.
Figure 5:
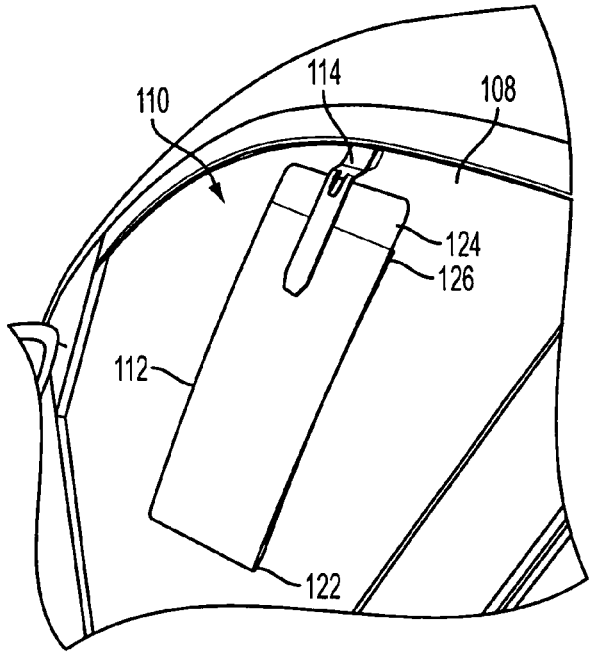
FIG. 5 is a perspective view of an alternative embodiment of a display assembly, in use on a car window.
Figure 7:
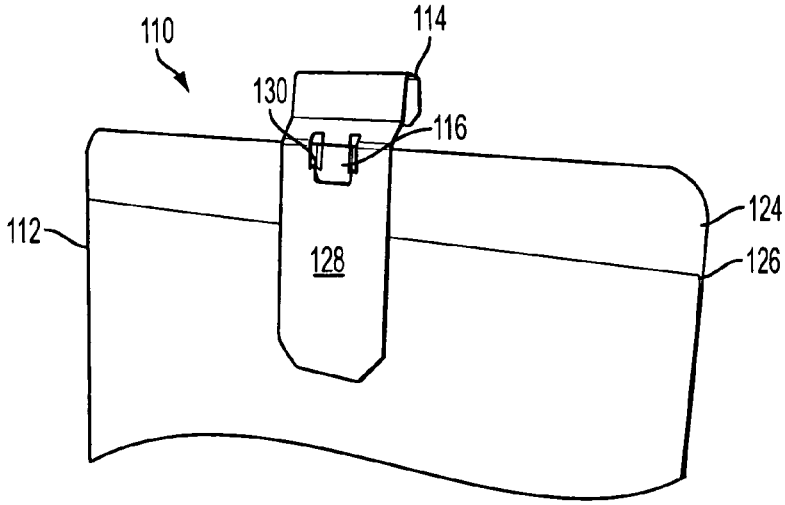
FIG. 7 is a perspective view of the top of the display assembly of FIG. 5.

Referring to FIGS. 5, 6 and 7, in an alternative preferred embodiment of display assembly 110, shown in FIGS. 5 and 6 placed over a car window 108, a clip 114 is crimped to a plastic sheet 112. Similar to the previously described embodiment sheet 112 has a fold 122 at the bottom, thereby forming a sheet front panel 124 and rear panel 126. Crimping is performed by arranging a small tongue 116 behind sheet 112 with a large tongue 128 in front of sheet 112 and pressing the two together about sheet 112. In one preferred embodiment a drop of adhesive is also used to join a large tongue 128 to the front of sheet 112. Spikes 130 embed into sheet 112, helping to form a positive bond. The crimping operation reduces the cost of manufacturing favorably in comparison with a purely adhesive bond.

In further detail, a clip front wall 134 is joined with large tongue 128 by a bridge 132, thereby defining a first included angle 138 between front wall 134 and bridge 132 and a second included angle 140 between bridge 132 and large tongue 128. The second included angle 140 is between 0.5 and 5 degrees smaller than first angle 138, causing the plane of tongue 128 to intersect with the plane of front wall 134 at angle of less than 180 degrees, facing window 108. This causes large tongue 128 and therefore front panel 124 to extend inwardly toward window 8, relative to front wall 134, which conforms to the top exterior plane of window 8. Consequently sheet 112 is pressed into car window 8, more affirmatively retaining any sheet placed between sheet panels 124 and 126 and avoiding air gaps between the front panel 124 and any slip placed within the fold of sheet placed between panels 124 and 126.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

The invention claimed is:

1. A method of presenting sales information to an automobile customer on an automobile having a window that may be slid vertically within a window frame having a top channel, comprising:

(a) providing an informational slip;

(b) providing a slip holder sized to accept and retain said information slip and having a top, a bottom, a front and a back, said slip holder including:

(i) a clip at said top and said front and having a front wall and a rear wall, mutually joined together by a top wall, said walls together defining a downwardly facing open channel, a tongue extending downwardly from said front wall; and (ii) a sheet of resiliently deformable material, of which a transparent front panel is attached to and extends downwardly from said tongue, said sheet being bent backwards at a bending point defining said sheet holder bottom and a rear panel extending upwardly from said bending point and defining an interior between said front panel and said rear panel;

(c) placing said informational slip in said interior so that information is displayed through said front panel;

(d) engaging said clip to the top of said automobile window so that said sheet extends downwardly in front of said window and engaging said window to said open channel of said window frame; and (e) said clip being formed so as to press said sheet into said window, thereby acting to reduce any gaps between said informational slip and said front panel and, as a consequence, enhancing slip visibility.

2. The method of claim 1, wherein said sheet is transparent over its entire extent.

3. The method of claim 1, wherein said clip is adhered to said sheet.

4. The method of claim 1, wherein said clip is crimped to said sheet.

5. The method of claim 1, wherein said clip is made of metal.

6. The method of claim 1, wherein said sheet is made of transparent plastic.

7. An article for displaying an informational slip so that it is visible on a sliding automobile window, and having a top, a bottom, a front and a back, said article comprising:

(a) a metal clip at said top and front, having a downwardly facing channel, defined in part by a front wall which is connected to a downwardly extending tongue by a downwardly and forwardly extending bridge, said front wall defining a front wall plane and said tongue defining a tongue plane and said front wall plane and said tongue plane defining a rearwardly facing wall tongue plane angle of less than 180 degrees;

(b) a downwardly extending plastic sheet attached to said tongue and that is bent in a rearward manner at about a 180 degree angle to form a transparent front panel and a rear panel; and (c) said tongue and thereby said plastic sheet extending rearwardly as they extend downwardly, thereby causing said plastic sheet to be pressed into a car window when said article is mounted on a car window by placing said downwardly facing channel ontop of a car window.

8. The article of claim 7, wherein said clip is adhered to said sheet.

9. The article of claim 7, wherein said clip is crimped to said sheet.

10. The article of claim 7, wherein said clip is made of metal.

11. The article of claim 7, wherein said sheet is made of transparent plastic.

12. An article for displaying an informational slip so that it is visible on a sliding automobile window, and having a top, a bottom, a front and a back, said article comprising:

(a) a metal clip at said top and front, having a front wall and a rear wall, mutually joined together by a top wall, said walls together defining a downwardly facing open channel, a large tongue extending downwardly from said front wall;

(b) a downwardly extending plastic sheet attached to said large tongue and that is bent in a rearward manner at about a 180 degree angle to form a transparent front Panel and a rear panel; and (c) said large tongue defining a through-hole and having a downwardly extending small tongue extending into said through-hole and wherein said small tongue and said large tongue are crimped into said plastic sheet.

* * * * *